US008009056B2

(12) United States Patent
Greene

(10) Patent No.: US 8,009,056 B2
(45) Date of Patent: Aug. 30, 2011

(54) MOVEMENT MONITOR FOR MEDICAL PATIENTS

(75) Inventor: Ted R. Greene, Poway, CA (US)

(73) Assignee: United Security Products, Inc., Poway, CA (US)

( * ) Notice: Subject to any disclaimer, the term of this patent is extended or adjusted under 35 U.S.C. 154(b) by 155 days.

(21) Appl. No.: 12/340,351

(22) Filed: Dec. 19, 2008

(65) Prior Publication Data

US 2010/0073180 A1 Mar. 25, 2010

Related U.S. Application Data

(63) Continuation-in-part of application No. 12/238,334, filed on Sep. 25, 2008.

(51) Int. Cl.
*G08B 21/00* (2006.01)
*G08B 23/00* (2006.01)

(52) U.S. Cl. ..... 340/667; 340/665; 340/666; 340/693.5; 340/693.6; 340/573.3; 340/573.4; 340/573.7

(58) Field of Classification Search ..... None
See application file for complete search history.

(56) References Cited

U.S. PATENT DOCUMENTS

| | | | | |
|---|---|---|---|---|
| 6,377,177 | B1 * | 4/2002 | Broussard et al. | 340/573.1 |
| 7,026,940 | B2 * | 4/2006 | Cherubini | 340/573.1 |
| 7,583,199 | B2 * | 9/2009 | Graebe, Jr. | 340/667 |
| 2002/0040264 | A1 * | 4/2002 | Inoue | 701/22 |
| 2002/0067273 | A1 * | 6/2002 | Jaques et al. | 340/573.4 |
| 2009/0315721 | A1 * | 12/2009 | Gottlieb et al. | 340/573.7 |
| 2010/0039269 | A1 * | 2/2010 | Newham | 340/573.4 |
| 2010/0109879 | A1 * | 5/2010 | Hamdan | 340/573.4 |

OTHER PUBLICATIONS

"Patient Alert Fall Prevention System" Flyer, published Apr. 2004 by United Security Products, Inc.
"Patient Alert PA-2 Wheelchair/Seat Fall Prevention System" Quick Start Guide, published Apr. 2004 by United Security Products, Inc.
"PA-6-22 Wheelchair-Seat Sensor Pad" User Manual Quick Start Guide, published Apr. 2004 by United Security Products, Inc.
"PA-7-22 Chair-Seat Sensor Pad" User Manual Quick Start Guide, published Apr. 2004 by United Security Products, Inc.

* cited by examiner

*Primary Examiner* — Julie Lieu
(74) *Attorney, Agent, or Firm* — Charles F. Reidelbach, Jr.

(57) ABSTRACT

A movement monitor includes a sensor pad for sensing when a weight is placed on the sensor pad and when the weight is removed from the sensor pad. A sleeve encloses the sensor pad. A control flap is formed in the sleeve for enclosing an alarm circuit coupled to the sensor pad.

29 Claims, 8 Drawing Sheets

MOVEMENT MONITOR FOR MEDICAL PATIENTS

CROSS REFERENCE TO RELATED APPLICATIONS

This application is a continuation-in-part of U.S. patent application Ser. No. 12/238,334 filed on Sep. 25, 2008, which is incorporated herein by reference.

BACKGROUND OF THE INVENTION

1. Field of the Invention

The present invention is directed generally to devices for detecting when a medical patient rises from a wheelchair or a bed and sounding an alarm to notify caregivers who may not be in the room. More specifically, but without limitation thereto, the present invention is directed to a movement monitor that integrates an alarm with a sensor pad.

2. Description of Related Art

Medical patients who are confined to a wheelchair or a bed may attempt to stand and walk without assistance from their wheelchair or bed, resulting in falls that may result in serious injury and even death if not immediately treated. In previous devices that address this problem, a sensing device (or sensor pad) is placed on the wheelchair or bed where the patient's body rests. The sensor pad is typically attached by several feet of wire to an alarm box placed nearby that sounds an alarm when the patient's weight is removed from the sensor pad.

SUMMARY OF THE INVENTION

In one embodiment, a movement monitor includes a sensor pad for sensing when a weight is placed on the sensor pad and when the weight is removed from the sensor pad. A sleeve encloses the sensor pad. A control flap is formed in the sleeve for enclosing an alarm circuit coupled to the sensor pad.

BRIEF DESCRIPTION OF THE DRAWINGS

The above and other aspects, features and advantages will become more apparent from the description in conjunction with the following drawings presented by way of example and not limitation, wherein like references indicate similar elements throughout the several views of the drawings, and wherein.

Elements in the figures are illustrated for simplicity and clarity and have not necessarily been drawn to scale. For example, the dimensions, sizing, and/or relative placement of some of the elements in the figures may be exaggerated relative to other elements to clarify distinctive features of the illustrated embodiments. Also, common but well-understood elements that may be useful or necessary in a commercially feasible embodiment are often not depicted in order to facilitate a less obstructed view of the illustrated embodiments.

DESCRIPTION OF THE ILLUSTRATED EMBODIMENTS

The following is a description of specific examples that embody general principles from which other embodiments may be derived. Accordingly, the illustrated embodiments are not intended to exclude other embodiments that may be derived from the same general principles within the scope of the appended claims. For example, certain actions or steps may be described or depicted in a specific order to be performed. However, practitioners of the art will understand that the specific order is only given by way of example and that the specific order does not exclude performing the described steps in another order to achieve substantially the same result. Also, the terms and expressions used in the description have the ordinary meanings accorded to such terms and expressions in the corresponding respective areas of inquiry and study except where other meanings have been specifically set forth herein.

A typical movement monitor includes a sensing device or sensor pad for placement on a wheelchair or bed and an alarm box that is connected to the sensor pad by several feet of wire. The alarm box sounds an alarm when the patient's body weight is removed from the sensor pad. A problem with this arrangement is that the wire may easily catch on nearby objects and may even pose a choking hazard or other risk factor to a patient. Also, the alarm box may fall and be damaged or disconnected from the sensor pad. A movement monitor that advantageously avoids these problems and that may provide other advantages is described as follows.

In one embodiment, a movement monitor includes a sensor pad for sensing when a weight is placed on the sensor pad and when the weight is removed from the sensor pad. A sleeve encloses the sensor pad. A control flap is formed in the sleeve for enclosing an alarm circuit coupled to the sensor pad.

Figure 1:
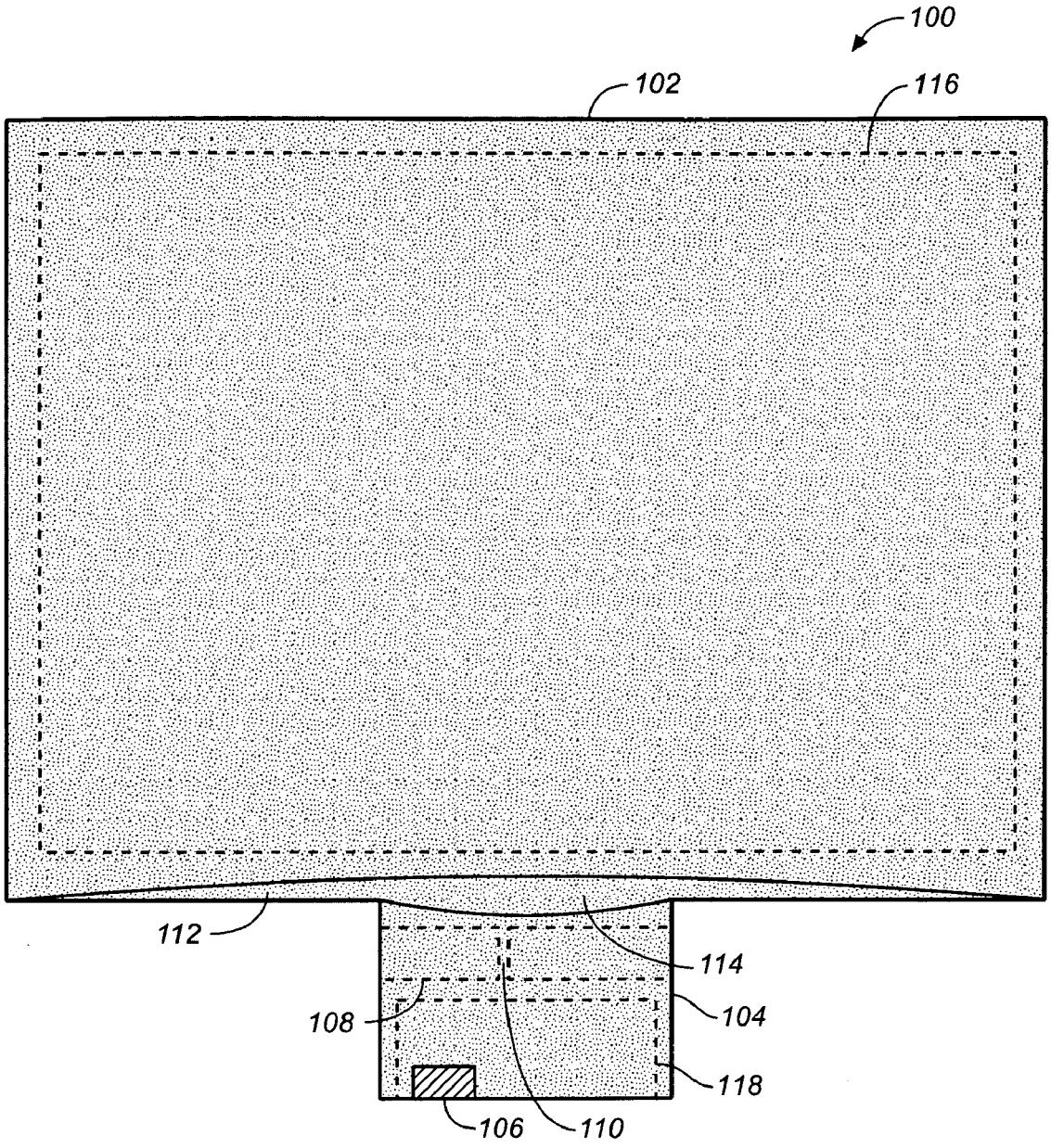
FIG. 1 illustrates a top view of a movement monitor for medical patients.

FIG. 1 illustrates a top view 100 of a movement monitor for medical patients. Shown in FIG. 1 are a slipcover 102, a control flap 104, a switch locator 106, compartment stitching 108, a wire tunnel 110, a slipcover opening 112, a control flap opening 114, a sensor pad 116, and an alarm circuit 118.

In the embodiment of FIG. 1, the slipcover 102 is dimensioned to fit on the seat of a wheelchair so that the slipcover 102 is prevented from slipping forward by the front posts that support the armrests of the wheelchair and from slipping backward by the rear posts that support the back of the wheelchair. In one embodiment, the slipcover 102 is made of two rectangular pieces of felt, vinyl, or heavy cloth sewn along three sides, leaving the slipcover opening 112 to insert the sensor pad 116 inside the slipcover 102. In another embodiment, the slipcover 102 includes fasteners such as snaps along the edge of the slipcover opening 112 to secure the sensor pad 116 inside the slipcover 102. Other types of fasteners may be used to fasten the edge of the slipcover opening 112, for example, hook and loop fasteners, to practice various embodiments within the scope of the appended claims. In another embodiment, the slipcover opening 112 is stitched or sewn together on all sides after inserting the sensor pad 116.

In one embodiment, both the top and bottom pieces of the slipcover 102 are cut out together from two layers of a flexible sheet material in the shape of a rectangle that includes a rectangular extension as shown in FIG. 1. In various embodiments, the flexible sheet material may be a fabric such as felt or cloth. In other embodiments, the flexible sheet material may be vinyl or a similar material. In a further embodiment, the flexible sheet material includes a slip resistant feature, for example, texturing or ridges, to avoid slipping on the wheelchair or on the bed. The top and bottom pieces of the slipcover 102 are sealed, glued, sewn or otherwise fastened together along one or more edges of the rectangle. In one embodiment, the rectangular extension on the upper piece is cut off and sewn to the rectangular extension on the lower piece to form the control flap 104, leaving the control flap opening 114 facing the slipcover opening 112 as shown in FIG. 1. The control flap 104 encloses the alarm circuit 118. The alarm circuit 118 is connected to the sensor pad 116 inside the slipcover 102 by a pair of wires routed through the wire tunnel 110. The wire tunnel 110 may be formed, for example, by stitching along a portion of the control flap opening 114, leaving a gap between the stitches as shown in FIG. 1. The stitching for the wire tunnel 110 may be added after the alarm circuit 118 is inserted in the control flap 104 and connected to the wires from the sensor pad 116.

The alarm circuit 118 may be, for example, the same the alarm circuit typically used in movement detectors in which the alarm circuit is enclosed in a plastic box and connected to a sensor pad by several feet of wire. The weight of the alarm circuit 118 inside the control flap 104 is preferably light enough not to let the slipcover 102 slide off the seat of the wheelchair when there is no body weight resting on the slipcover 102. On the other hand, the weight of the alarm circuit 118 in the control flap 104 helps keep the slipcover 102 from sliding forward in the wheelchair when patients rise from the wheelchair. In FIG. 1, the alarm circuit is held securely in place inside the control flap 104 by the compartment stitching 108. The compartment stitching 108 may be added after the alarm circuit 118 is inserted in the control flap 104 and connected to the wire from the sensor pad 116.

In one embodiment, the alarm circuit 118 includes an audible alarm. The audible alarm may be, for example, a pulsing sound or a recorded voice that warns the patient that he or she should not stand or walk alone when the patient's body weight is removed from the sensor pad 116. In other embodiments, the audible alarm may stop when the sensor pad 116 again senses the body weight of the patient or after a timed alarm interval. In another embodiment, the alarm circuit 118 includes a wireless transmitter that sounds an alarm at a remote location, for example, at a nurse station or a caregiver's cell phone. The control flap 104 also helps hold the slipcover 102 in place on the seat when the control flap 104 hangs below the back of the seat of a wheelchair or over a bed rail. The location of the control flap 104 behind a wheelchair seat is not easily accessible by someone sitting in the wheelchair, which helps prevent a patient from intentionally switching off the movement monitor. In another embodiment, the control flap 104 is elongated so that it hangs over the side of a bed beyond the reach of a patient lying on the bed. The control flap 104 may be folded over or under the slipcover 102 for conveniently storing the movement monitor on a shelf or in a cabinet. The slipcover 102 may also be folded over and under itself for convenient storing of the movement monitor on a shelf or in a cabinet.

In one embodiment, the switch locator 106 includes a patch on the outside surface of the control flap 104 having a color that distinguishes the switch locator 106 from the control flap 104 to provide a visual indication of the location of a power switch on the alarm circuit 118. In another embodiment, the switch locator 106 includes a tactile feature such as texture or thickness that distinguishes the switch locator 106 from the control flap 104 so that a switch on the alarm circuit 118 inside the control flap 104 may be conveniently located by touch and switched by a caregiver from the outside of the control flap 104.

Figure 2:
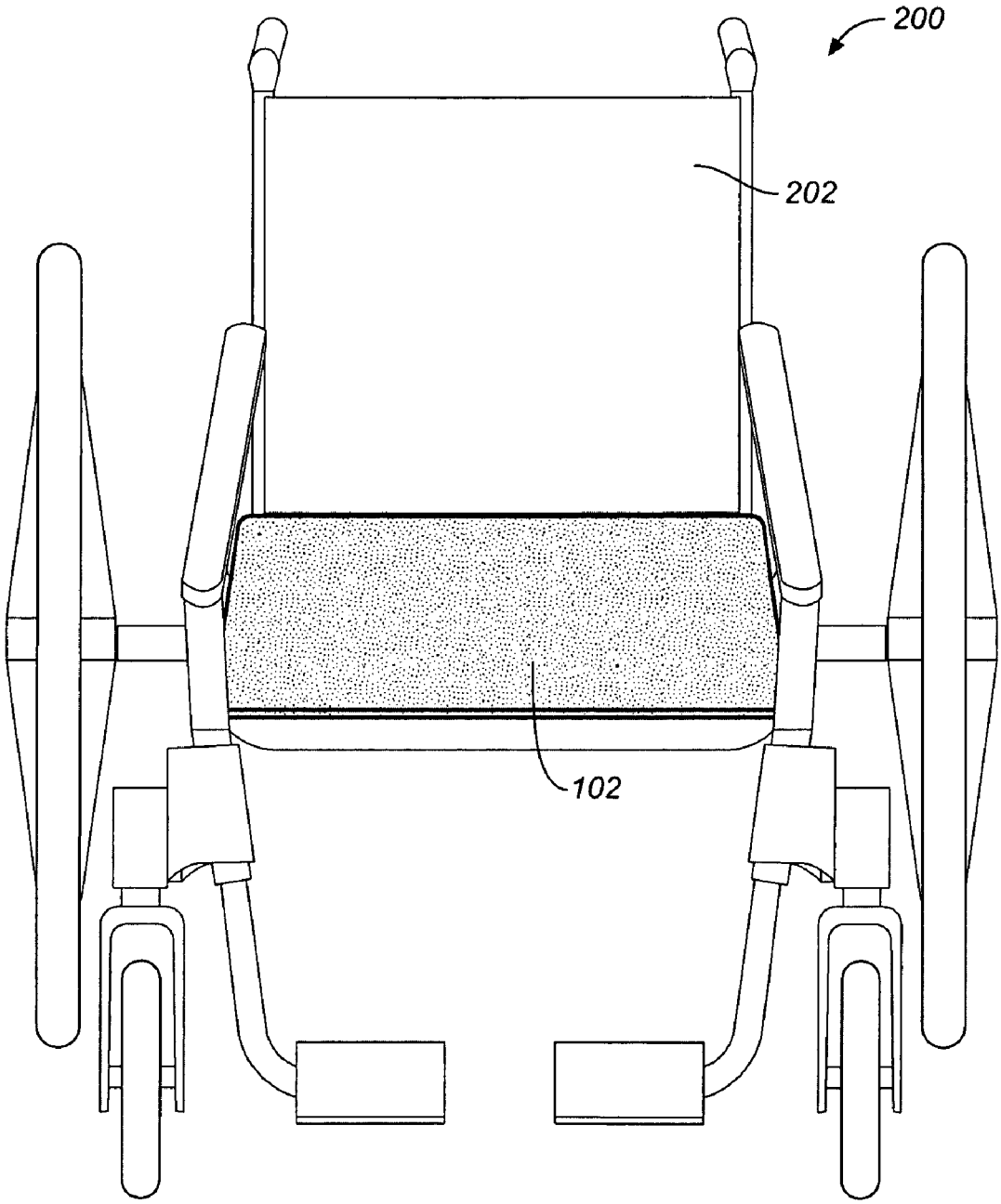
FIG. 2 illustrates a front view of the movement monitor of FIG. 1 as used with a wheelchair.

FIG. 2 illustrates a front view 200 of the movement monitor of FIG. 1 as used with a wheelchair. Shown in FIG. 2 are a slipcover 102 and a wheelchair 202.

In the embodiment of FIG. 2, the slipcover 102 fits on the seat of the wheelchair 202 so that it is constrained from slipping forward or backward from the front posts that support the armrests and by the back posts that support the back of the wheelchair 202.

Figure 3:
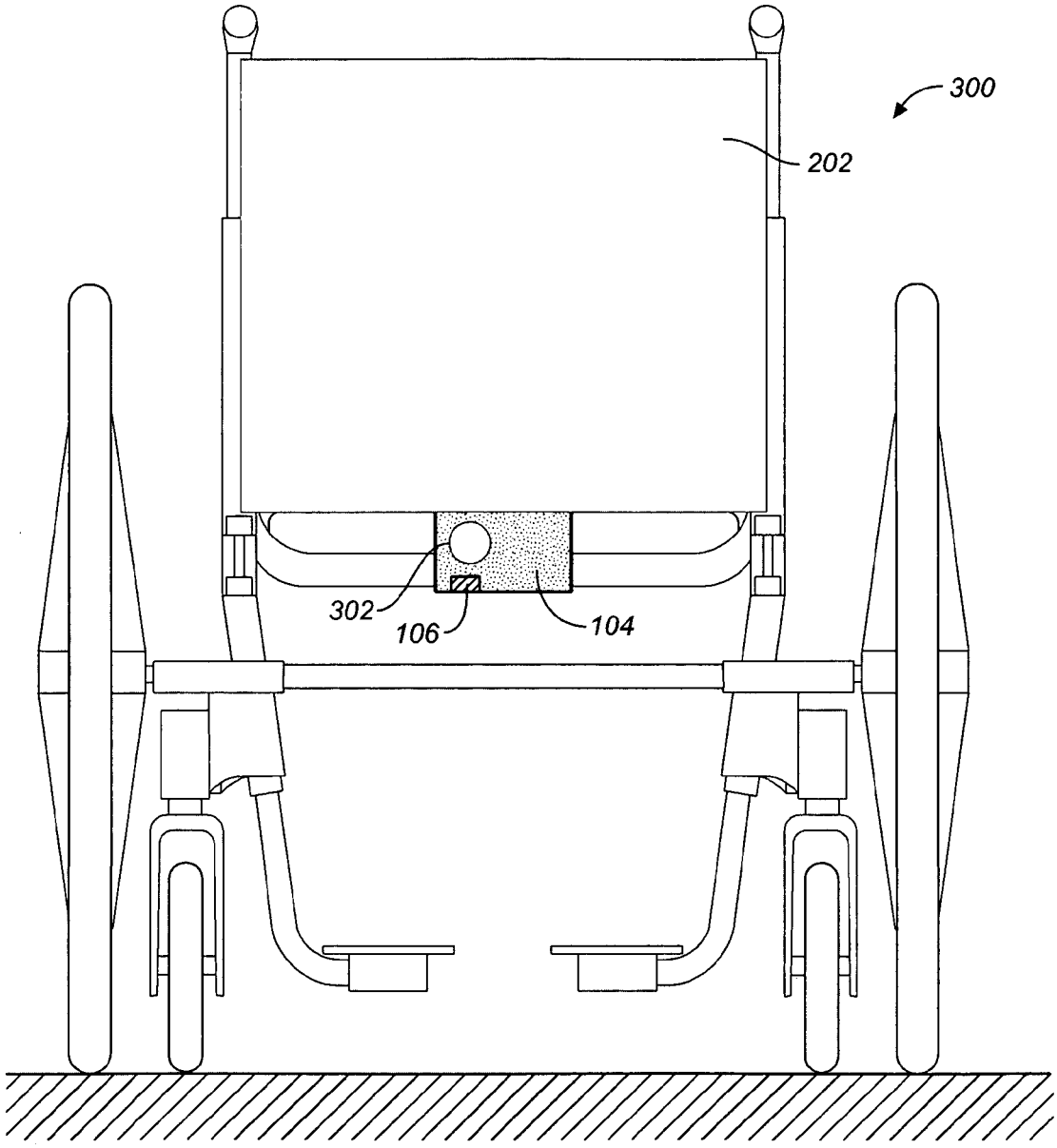
FIG. 3 illustrates a rear view of the movement monitor of FIG. 1 as used with a wheelchair and more particularly the placement of the control flap of the movement monitor in a wheelchair.

FIG. 3 illustrates a rear view 300 of the movement monitor of FIG. 1 as used with a wheelchair and more particularly the placement of the control flap of the movement monitor in a wheelchair. Shown in FIG. 3 are a control flap 104, a switch locator 106, a wheelchair 202, and a speaker diaphragm 302.

In the embodiment of FIG. 3, the control flap 104 is inserted between the seat and the back of the wheelchair 202 so that the control flap 104 hangs down behind the back of the wheelchair 202 when the sensor pad is resting on the seat of the wheelchair 202.

The switch locator 106 indicates the location of the switch on the alarm circuit 118 inside the control flap 104. The switch may be conveniently switched on or off from the outside of the control flap 104 by a caregiver, while remaining generally inaccessible to a patient sitting in the wheelchair 202.

In one embodiment, the speaker diaphragm 302 of the alarm circuit 118 in FIG. 1 is mounted flush with the outside of the control flap 104. In another embodiment, the speaker diaphragm 302 is mounted inside the control flap 104, for example, to protect the speaker diaphragm 302 from liquids and other hazards.

Figure 4:
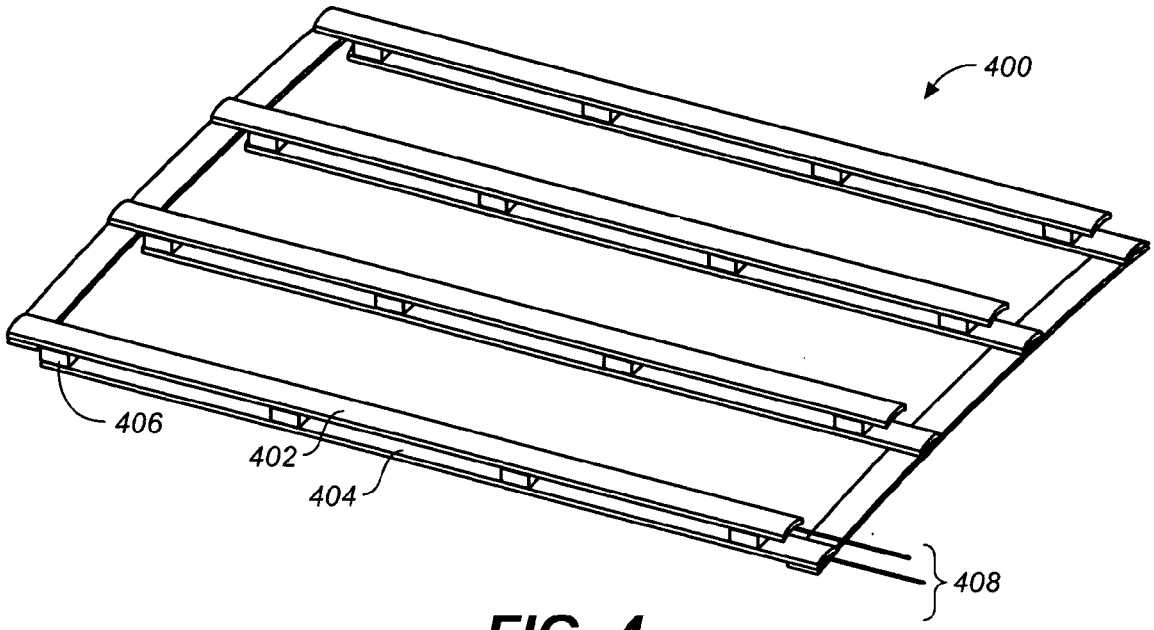
FIG. 4 illustrates a perspective view of a sensor pad for the movement monitor of FIG. 1.

FIG. 4 illustrates a perspective view 400 of a sensor pad for the movement monitor of FIG. 1. Shown in FIG. 4 are an upper contact 402, a lower contact 404, insulating spacers 406, and contact wires 408.

In the embodiment of FIG. 4, the upper contact 402 and the lower contact 404 are each made of strips of a resilient, electrically conductive material such as stainless steel and arranged in a vertically parallel pattern. In one embodiment, the parallel strips have a width of about 2 cm, a length of about 35 cm, and a thickness of about 0.1 mm. In one embodiment, the parallel strips have a curved cross-section that increases the return force that straightens and separates the strips when a weight that presses the strips together to make electrical contact with each other is removed from the sensor pad. Insulating spacers 406 separate the contacts 402 and 404 at intervals of about 8 cm so that the contacts 402 and 404 do not make electrical contact with each other when no weight is present to press them together. The insulating spacers 406 may be made of, for example, squares of a double-sided urethane tape having about the same width as the contacts 402 and 404 and a thickness of about 2 mm. Other materials and dimensions may be used to make the upper contact 402, the lower contact 404, and the insulating spacers 406 according to well-known techniques within the scope of the appended claims.

The contacts 402 and 404 each are arranged in a parallel grid that is connected at one end by a flat strip of an electrically conductive material such as stainless steel. The spacing between adjacent pairs of contacts 402 and 404 in the grid may be, for example, about 5 cm. One end of each of the contact wires 408 is connected respectively to the contacts 402 and 404. The opposite ends of the contact wires 408 are passed through the wire tunnel 110 for connecting to the alarm circuit 118 in FIG. 1.

In one embodiment, the sensor pad of FIG. 4 is enclosed in a vinyl sleeve according to well-known techniques to provide mechanical stability with flexibility to keep the sensor pad from twisting, to protect the contacts 402 and 404 from moisture damage, and to isolate the contacts 402 and 404 from foreign objects. In another embodiment, the vinyl sleeve and the contacts 402 and 404 are enclosed in a foam cushion for added comfort.

Sensor pads are typically discarded by hospitals within 30 days. Because the sensor pad and the alarm circuit in the movement monitor of FIG. 1 may last up to a year or more, the movement monitor may be packaged with a prepaid mailer envelope addressed to the manufacturer or a distributor for convenient disposal and recycling.

Figure 5:
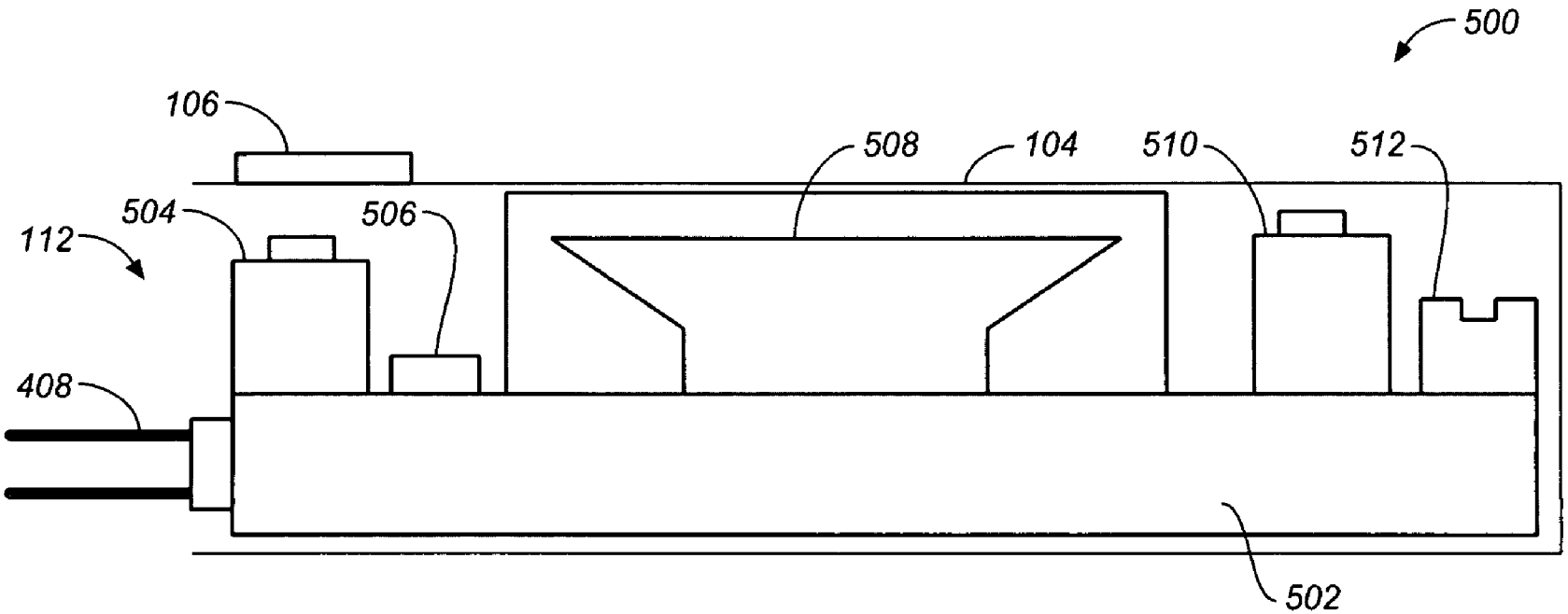
FIG. 5 illustrates a side view of an alarm circuit inside the control flap of FIG. 1.

FIG. 5 illustrates a side view 500 of an alarm circuit 502 inside the control flap of FIG. 1. Shown in FIG. 5 are a control flap 104, a switch locator 106, contact wires 408, an alarm circuit 502, a switch 504, a battery 506, a loudspeaker 508, a volume control 510, and a remote alarm jack 512.

In the embodiment of FIG. 5, the contact wires 408 are connected by an electrical connector to the alarm circuit 502. The alarm circuit 502 includes components such as the switch 504, the battery 506, the loudspeaker 508, the volume control 510, and the remote alarm jack 512. The switch 504 switches the power from the battery 506 to the alarm circuit 502. The switch 504 may be, for example, a push-button switch, a toggle switch, a slide switch, a rocker switch, or other type of switch to practice various embodiments according to well-known techniques within the scope of the appended claims.

In various embodiments, the switch 504 controls the operation of the alarm circuit 502. In one embodiment, the switch 504 is an ON-OFF switch. In another embodiment, the switch 502 selects one of several states, for example, two powered states and one non-powered "off" state. In one embodiment, one of the two powered states functions as a powered monitoring state that sounds an alarm from the loudspeaker 508 when the patient's body weight is removed from the sensor pad. In another embodiment, one of the two powered states functions as a powered monitoring state that sounds an alarm from the loudspeaker 508 when the patient's body weight is placed on the sensor pad, for example, when the movement monitor is used on the floor next to a bed to signal when a patient is rising from the bed.

In another embodiment, one powered state functions as a "pause" state that temporarily disables the movement monitor alarm, for example, when the patient leaves the wheelchair with the assistance of a caregiver. In the "pause" state, a reduced alarm volume, a series of beeps, or other audible signal is emitted by the loudspeaker 508 at regular intervals to remind the caregiver that the movement monitor is in the "pause" state and that the switch 504 should be switched either to the powered monitoring state once the patient is re-seated to resume monitoring or to the non-powered "off" state to discontinue monitoring.

In a further embodiment, the "pause" state is terminated after a timed interval, and the movement monitor is switched automatically either to the powered monitoring state or to the non-powered "off" state. The switch 504, or some part of the switch 504, may be visually located by the switch locator 106 from outside the control flap 104 of FIG. 1.

In a further embodiment, the volume of the alarm emitted by the loudspeaker 508 may be adjusted by the volume control 510. In various embodiments, the volume control 510 is implemented as a sliding arm, a rotating shaft, or as pushbutton switches for selecting low, medium or high volume.

In another embodiment, the remote alarm jack 512 receives a cable that connects the alarm circuit 502, for example, to a service jack in a hospital room used to connect a call button to a nurse station. In one embodiment, a "Y" connector or a connector manifold connects the cables from the remote alarm jack 512 and the call button to the service jack. The alarm circuit 502 provides a signal to the remote alarm jack 512, for example, a normally open circuit that switches to a closed circuit when the patient's body weight is removed and/or restored to the sensor pad.

In other embodiments, alarm circuit 502 may stop the audible alarm, for example, when the sensor pad senses that the patient has returned to the wheelchair or bed, or after a predetermined time interval has expired. In another embodiment, the alarm circuit 502 includes a wireless transmitter that sounds an alarm at a remote location, for example, at a nurse station or a caregiver's cell phone.

The functions described above for the alarm circuit 502 may be implemented according to well-known circuit design techniques. The arrangement of the components on the alarm circuit 502 may be varied to suit specific applications within the scope of the appended claims.

Figure 6:
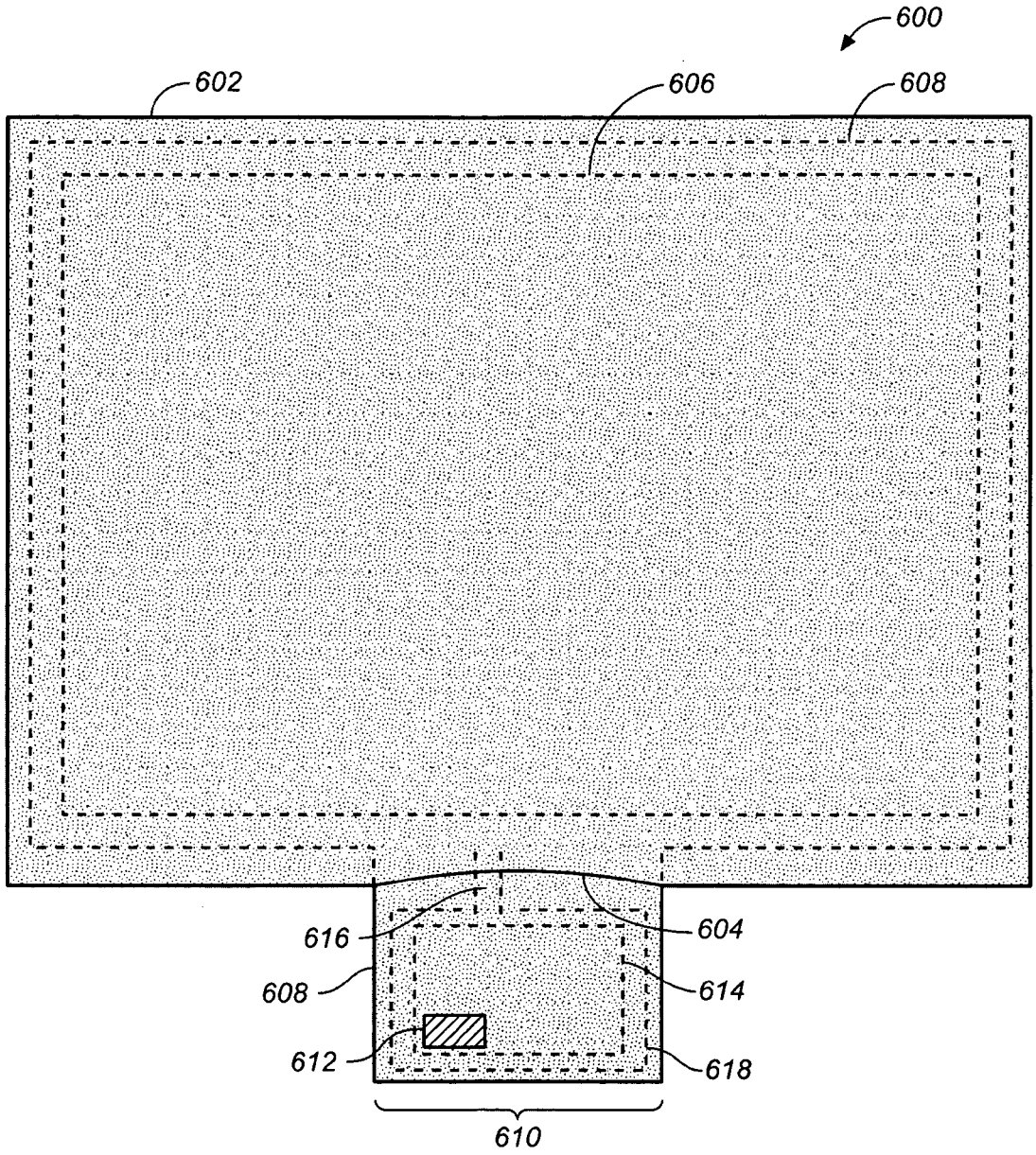
FIG. 6 illustrates a top view of a movement monitor for medical patients that integrates the control flap with the sleeve that encloses the sensor pad.

FIG. 6 illustrates a top view 600 of a movement monitor for medical patients that integrates the control flap with the sleeve that encloses the sensor pad. Shown in FIG. 6 are a slipcover 602, a slipcover opening 604, a sensor pad 606, a sleeve 608, a control flap 610, a switch locator 612, an alarm circuit 614, a wire tunnel 616, and a compartment 618.

In FIG. 6, the control flap 610 that encloses the alarm circuit 614 is formed as an extension of the sleeve 608 that encloses the sensor pad 606. In one embodiment, the sleeve 608 is made of a flexible sheet material, such as vinyl. The embodiment of FIG. 6 also includes the slipcover 602, which is also preferably made of a flexible sheet material such as felt, vinyl, or heavy cloth. In various embodiments, the flexible sheet material for the sleeve 608 and/or the slipcover 602 includes a slip resistant feature, for example, texturing or ridges, to avoid slipping on the wheelchair or on the bed. The slipcover 602 covers the sensor pad 606 and includes the slipcover opening 604 that fits around the sleeve 608 where the control flap 610 extends away from the sensor pad 606.

The sensor pad 606, the switch locator 612, and the alarm circuit 614 may be made, for example, in the same manner as described above with reference to FIG. 1. In one embodiment, the alarm circuit 614 is secured in the compartment 618 formed inside the control flap 610 and connected to the sensor pad 606 by a wire routed inside the wire tunnel 616 between the sensor pad 606 and the alarm circuit 614. The compartment 618 and the wire tunnel 616 may be formed inside the sleeve 608, for example, by heat sealing seams in the flexible sheet material of the sleeve 608 according to well-known techniques. In another embodiment, the sensor pad 606 and the alarm circuit 614 are made water-resistant in the movement monitor by heat-sealing the edges of the sleeve 608 around the sensor pad 606 and the control flap 610, thereby blocking moisture from contacting the sensor pad 606 and the alarm circuit 614. The edges of the sleeve 608 around the sensor pad 606 and the control flap 610 may be stitched, sewn, heat sealed with RF or Ultrasound, glued, or cemented according to well-known techniques to practice various embodiments within the scope of the appended claims.

Figure 7:
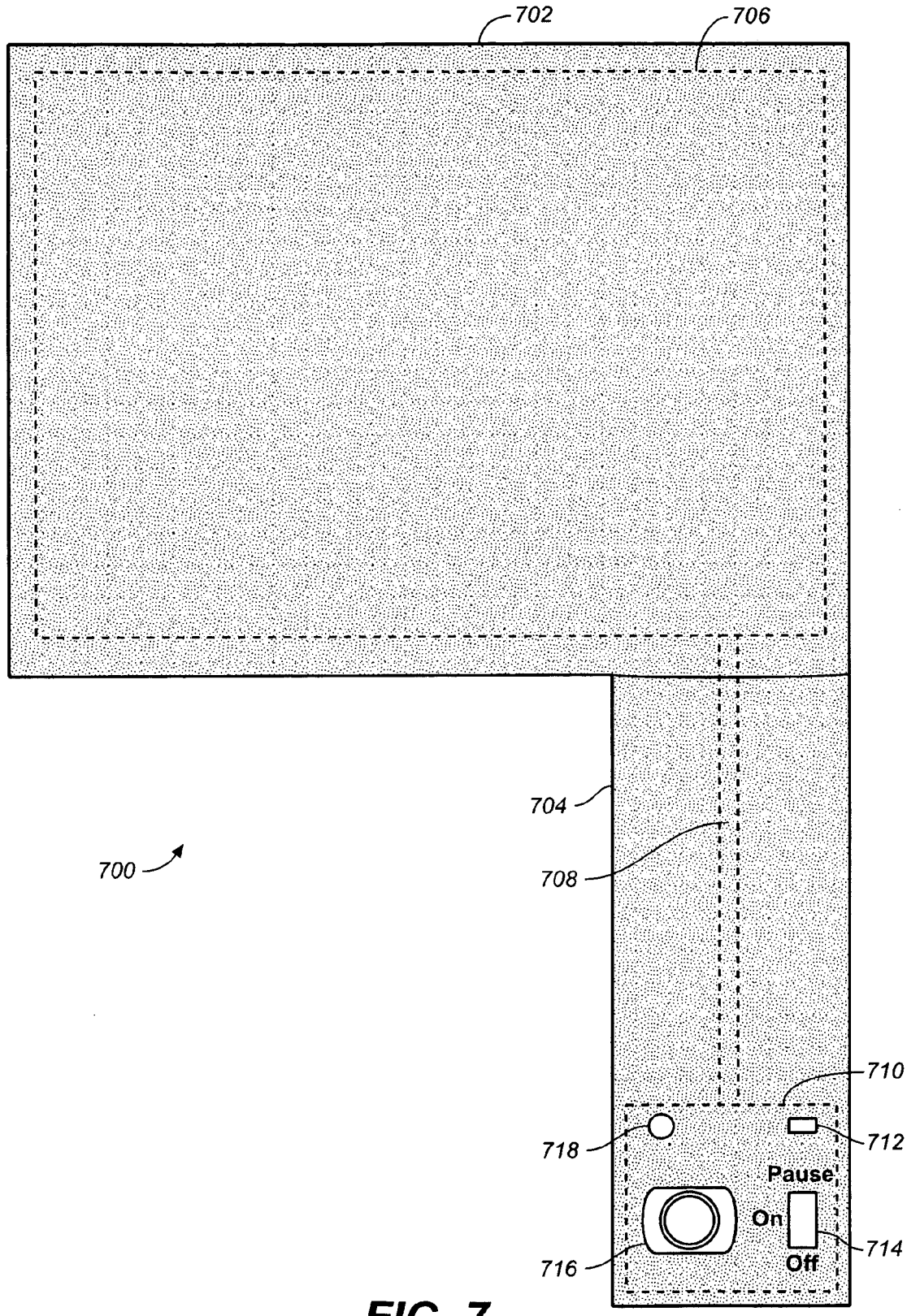
FIG. 7 illustrates a top view of a movement monitor for medical patients that integrates an alarm circuit in an elongated extension of the sleeve that encloses the sensor pad.

FIG. 7 illustrates a top view 700 of a movement monitor for medical patients that integrates an alarm circuit in an elongated extension of the sleeve that encloses the sensor pad.

Shown in FIG. 7 are a sleeve 702, a control flap extension 704, a sensor pad 706, a wire tunnel 708, an alarm circuit 710, a remote alarm jack 712, a switch locator 714, a loudspeaker diaphragm 716, and a volume control locator 718.

In FIG. 7, the control flap extension 704 is formed in the sleeve 702 that encloses the sensor pad 706. In one embodiment, the sleeve 702 is made of a flexible sheet material, such as vinyl. In various embodiments, the flexible sheet material for the sleeve 702 includes a slip resistant feature, for example, texturing or ridges, to avoid slipping on a wheelchair or on a bed. In other embodiments, the portion of the sleeve 702 that encloses the sensor pad 706 has a width and length selected to fit on a wheelchair, on a bed, or on a floor next to a bed. For example, the sleeve 702 may have a width and length of 20 inches by 30 inches for use on a bed and 25 inches by 30 inches for use on a floor next to a bed.

In one embodiment, the control flap extension 704 has a length selected to hang over the edge of the bed below the bottom of the bed rail and above the floor so that the alarm circuit 710 is out of the way of a patient lying on the bed. The sensor pad 706 is connected to the alarm circuit 710 by the wire tunnel 708 as described above with reference to FIG. 6.

The sensor pad 706 and the alarm circuit 710 may be made, for example, in the same manner as described above with reference to FIGS. 4 and 5. In one embodiment, the remote alarm jack 712 on the alarm circuit 710 is accessible through a hole in the control flap extension 704. The switch locator 714 may be, for example, a patch or printed indicia on the control flap extension 704 that provide a visual indication of the location of the alarm circuit switch inside the control flap extension 704. In another embodiment, the alarm circuit switch protrudes through a hole in the control flap extension 704, and the switch locator 714 includes indicia to indicate each switch position, for example, "OFF", "ON", and "PAUSE".

In various embodiments, the loudspeaker diaphragm 716 of the loudspeaker on the alarm circuit 710 is fastened to the inside of the control flap extension 704 or mounted flush with the control flap extension 704. In one embodiment, the loudspeaker diaphragm 716 protrudes through an opening in the control flap extension 704. In other embodiments, the control flap extension 704 includes a pattern of holes or a grille formed in or fastened to the control flap extension 704 to improve sound transmission efficiency from the loudspeaker diaphragm 716.

In another embodiment, the volume control locator 718 is included to provide a visual indication for the volume control on the alarm circuit 710. The volume control locator 718 may be, for example, indicia printed on the control flap extension 704 over pushbutton switches that set the loudspeaker volume to a low, medium, or high level. In another embodiment, the volume control locator 718 may be a label next to an opening in the control flap extension 704 through which a shaft or arm of the volume control on the alarm circuit 710 protrudes.

The arrangement and the appearance of the remote alarm jack 712, the switch locator 714, the loudspeaker diaphragm 716, and the volume control locator 718 on the control flap extension 704 may be varied to suit specific applications within the scope of the appended claims.

Figure 8:
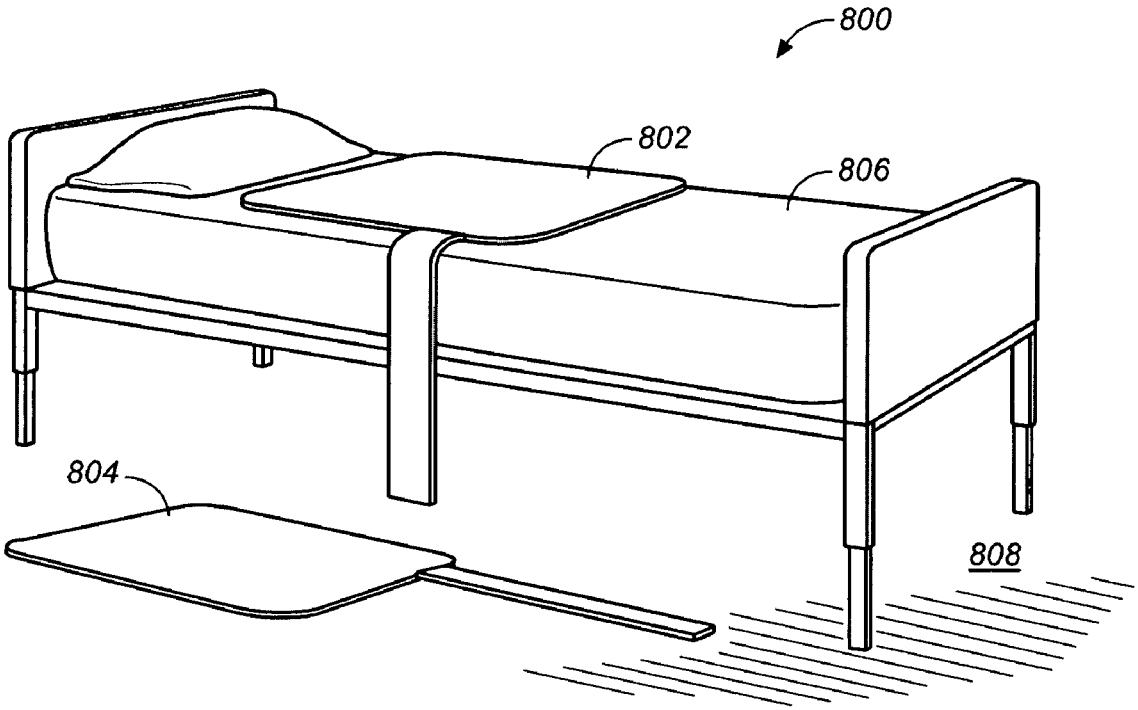
FIG. 8 illustrates a perspective view of the movement monitor of FIG. 7 placed on a hospital bed and on the floor by the bed.

FIG. 8 illustrates a perspective view 800 of the movement monitor of FIG. 7 placed on a hospital bed and on the floor by the bed. Shown in FIG. 8 are movement monitors 802 and 804, a hospital bed 806, and a floor 808.

In FIG. 8, the movement monitor 802 is placed on the hospital bed 806 so that the control flap extension hangs over the side of the bed, preferably so that the alarm circuit is below the bed rail and above the floor out of the way of the patient and accessible to the caregiver. In various embodiments, the sensor pad of the movement monitor 802 is placed under a mattress pad and bed sheet, under a bed pad, or directly beneath the patient's hips and upper legs. The distance and the downward angle of the control flap extension from the sensor pad in the movement monitor 802 provide added protection from moisture and accidental damage. In one embodiment, the movement monitor 802 generates an alarm signal, for example, a tone or a verbal warning, when the patient's weight is lifted from the sensor pad and discontinues the alarm signal when the patient's is again detected by the sensor pad.

In another embodiment, the movement monitor 804 is placed on the floor 808 next to the hospital bed 806, preferably so that the sensor pad covers the area where the patient stands on the floor 808 to rise from the hospital bed 806 and so that the control flap extension lies under the bed out of the way of the patient. The alarm circuit controls may be conveniently set by the caregiver before placing the movement monitor 804 on the floor 808. The movement monitor 804 generates an alarm signal, for example, a tone or a verbal warning, when the patient's weight is detected by the sensor pad to notify a caregiver that the patient is rising from the bed.

The movement monitor described above may also be employed in other applications, for example, as a passenger warning device in vehicles such as cars, school buses, prisoner buses, aircraft, and other transportation devices. Further possible applications include monitoring doors, toilets, and entry ways for Alzheimer's patients, children, and personnel in secure areas such as controlled access rooms, for example, a store room in a convenience store, an x-ray or MRI room in a hospital, or a machine room. Other applications may include monitoring areas where animals are kept.

The specific embodiments and applications thereof described above are for illustrative purposes only and do not preclude modifications and variations that may be made within the scope of the following claims.

What is claimed is:

1. A movement monitor comprising:

a sensor pad for sensing when a weight is placed on the sensor pad and when the weight is removed from the sensor pad;

a sleeve enclosing the sensor pad;

a control flap formed in the sleeve for enclosing an alarm circuit coupled to the sensor pad; and a switch locator outside the control flap comprising a tactile feature that distinguishes the switch locator from the control flap.

2. The movement monitor of claim 1 further comprising a slipcover that covers the sleeve.

3. The movement monitor of claim 2 further comprising an opening in the slipcover through which the control flap extends.

4. The movement monitor of claim 2, the slipcover comprising a flexible sheet material.

5. The movement monitor of claim 4, the flexible sheet material comprising a fabric.

6. The movement monitor of claim 1, the sleeve comprising a flexible sheet material.

7. The movement monitor of claim 6, the flexible sheet material comprising vinyl.

8. The movement monitor of claim 6 comprising a seal formed in the sleeve to block moisture from the sensor pad.

9. The movement monitor of claim 1 further comprising the alarm circuit.

10. The movement monitor of claim 9 further comprising a compartment formed in the control flap to secure the alarm circuit in the control flap.

11. The movement monitor of claim 9 further comprising a wire tunnel formed in the control flap for connecting a wire between the alarm circuit and the sensor pad.

12. The movement monitor of claim 9 further comprising a switch locator outside the control flap to provide a visual indication of a location of a switch on the alarm circuit inside the control flap.

13. The movement monitor of claim 12, the switch locator comprising a color that distinguishes the switch locator from the control flap.

14. The movement monitor of claim 1, the sensor pad comprising electrical contacts that make electrical contact when a weight is placed on the sensor pad.

15. The movement monitor of claim 14, the electrical contacts comprising a pair of parallel strips of an electrically conductive material separated at intervals by an insulating material so that the strips make electrical contact with each other when a weight rests on the sensor pad and break electrical contact with each other when the weight is not resting on the sensor pad.

16. The movement monitor of claim 15, the parallel strips comprising a curved cross-section.

17. The movement monitor of claim 1 comprising the control flap formed in the sleeve so that the control flap extends through the back of a wheelchair seat when the sensor pad is resting on the wheelchair seat.

18. The movement monitor of claim 1 comprising the control flap formed in the sleeve so that the control flap extends over a side of a bed when the sensor pad is placed on the bed.

19. The movement monitor of claim 9, the alarm circuit comprising a switch for selecting a powered state and a non-powered state.

20. The movement monitor of claim 19, the powered state comprising generating an alarm signal when the weight is removed from the sensor pad or when the weight is placed on the sensor pad.

21. The movement monitor of claim 20, the alarm signal comprising an audible alarm.

22. The movement monitor of claim 21, the alarm circuit comprising a volume control for selecting a volume of the alarm signal.

23. The movement monitor of claim 22, the control flap comprising a volume control locator.

24. The movement monitor of claim 20, the alarm signal comprising a call signal to a nurse station.

25. The movement monitor of claim 19, the powered state comprising terminating an alarm signal when the weight is removed from the sensor pad or when the weight is placed on the sensor pad.

26. The movement monitor of claim 9, the alarm circuit comprising a loudspeaker having a diaphragm mounted flush with an outside surface of the control flap.

27. A movement monitor comprising:

a slipcover for enclosing a sensor pad;

a flap pocket that extends from the slipcover;

a compartment formed in the flap pocket for securing a circuit board inside the flap pocket;

a switch locator fastened to the flap pocket, the switch locator providing a visual indication of a location of a switch on the circuit board inside the flap pocket, the switch locator having a tactile feature to provide a tactile indication of a location of a switch inside the flap pocket.

28. A movement monitor comprising:

a slipcover for enclosing a sensor pad;

a flap pocket that extends from the slipcover;

a compartment formed in the flap pocket for securing a circuit board inside the flap pocket; and an opening in the slipcover facing the flap pocket for inserting the sensor pad into the slipcover.

29. The movement monitor of claim 28 comprising an opening in the flap pocket facing the opening in the slipcover for inserting the circuit board into the flap pocket.

* * * * *